US009191753B2

(12) United States Patent
Meincke et al.

(10) Patent No.: US 9,191,753 B2
(45) Date of Patent: Nov. 17, 2015

(54) HEARING AID AND A METHOD OF ENHANCING SPEECH REPRODUCTION

(71) Applicant: Widex A/S, Lynge (DK)

(72) Inventors: Mette Dahl Meincke, Varlose (DK); Andreas Brinch Nielsen, København N (DK)

(73) Assignee: Widex A/S, Lynge (DK)

( * ) Notice: Subject to any disclaimer, the term of this patent is extended or adjusted under 35 U.S.C. 154(b) by 257 days.

(21) Appl. No.: 13/826,772

(22) Filed: Mar. 14, 2013

(65) Prior Publication Data

US 2013/0195302 A1 Aug. 1, 2013

Related U.S. Application Data

(63) Continuation-in-part of application No. PCT/EP2010/069154, filed on Dec. 8, 2010.

(51) Int. Cl.
*H04R 25/00* (2006.01)
*G10L 21/02* (2013.01)
(Continued)

(52) U.S. Cl.
CPC ..... *H04R 25/50* (2013.01); *G10L 21/02* (2013.01); *H04R 25/356* (2013.01);
(Continued)

(58) Field of Classification Search
CPC ..... A61F 11/04; G10K 11/1784; G10K 11/1788; G10K 2210/108; G10K 2210/1081; G10K 2210/129; G10K 2210/3023; G10K 2210/30232; G10K 2210/3025; G10K 2210/3031; G10K 2210/30351; G10K 2210/3045; G10K 2210/3051; G10K 2210/3053; G10L 21/02; G10L 21/0232; G10L 25/78; G10L 2021/065; G10L 25/93; H04R 25/50; H04R 25/356; H04R 2225/43
USPC ..... 381/312, 315, 320, 71.6, 72, 94.7
See application file for complete search history.

(56) References Cited

U.S. PATENT DOCUMENTS

2004/0175010 A1 9/2004 Allegro et al.
2011/0286618 A1* 11/2011 Vandali et al. ..... 381/320

FOREIGN PATENT DOCUMENTS

FR 2846136 A1 4/2004
GB 2091065 A 7/1982
(Continued)

OTHER PUBLICATIONS

International Search Report with Written Opinion of the International Searching Authority for PCT/EP2010/069154 dated Aug. 12, 2011.

*Primary Examiner* — Davetta W Goins
*Assistant Examiner* — Phylesha Dabney
(74) *Attorney, Agent, or Firm* — Sughrue Mion, PLLC

(57) ABSTRACT

A hearing aid (60A) configured to be worn by a hearing-impaired user has a speech detector (10A) and a speech enhancer (40A) for enhancing speech being present in an input signal of the hearing aid (60A). The speech detector (10A) has means (11, 12) for independently detecting the presence of voiced and unvoiced speech in order to allow for the speech enhancer (40A) to increase the gain of speech signals suitably fast to incorporate the speech signals themselves. The hearing aid (60A) has means (49A, 50A) for communicating information regarding the detected speech signals wirelessly to a similar hearing aid (60B) worn contralaterally by the user for the purpose of mutually enhancing speech signals in the two hearing aids (60A, 60B) when speech is detected to be originating from the front of the user, and means (52B) for suppressing speech enhancement in the contralateral hearing aid (60B) when speech is detected to be originating from the ipse-lateral side of the user. The invention further provides a method of enhancing speech in a hearing aid.

10 Claims, 4 Drawing Sheets

(51) Int. Cl.

| | |
|---|---|
| *G10L 21/0232* | (2013.01) |
| *G10L 25/78* | (2013.01) |
| *G10L 25/93* | (2013.01) |
| *G10L 21/06* | (2013.01) |

(52) U.S. Cl.

CPC ..... *G10L 21/0232* (2013.01); *G10L 25/78* (2013.01); *G10L 25/93* (2013.01); *G10L 2021/065* (2013.01); *H04R 2225/43* (2013.01)

(56) References Cited

FOREIGN PATENT DOCUMENTS

| | | | |
|---|---|---|---|
| WO | 98/27787 | A1 | 6/1998 |
| WO | 2004/008801 | A1 | 1/2004 |
| WO | 2010/083879 | A1 | 7/2010 |

* cited by examiner

HEARING AID AND A METHOD OF ENHANCING SPEECH REPRODUCTION

RELATED APPLICATIONS

The present application is a continuation-in-part of application PCT/EP2010/069154, filed on 8 Dec. 2010, in Europe, and published as WO2012076045 A1.

BACKGROUND OF THE INVENTION

1. Field of the Invention

This application relates to hearing aids. The invention, more specifically, relates to hearing aids having means for enhancing speech reproduction. The invention further relates to a method of processing signals in a hearing aid.

A hearing aid is defined as a small, battery-powered device, comprising a microphone, an audio processor and an acoustic output transducer, configured to be worn in or behind the ear by a hearing-impaired person. By fitting the hearing aid according to a prescription calculated from a measurement of a hearing loss of the user, the hearing aid may amplify certain frequency bands in order to compensate the hearing loss in those frequency bands. In order to provide an accurate and flexible means of amplification, most modern hearing aids are of the digital variety. Digital hearing aids incorporate a digital signal processor for processing audio signals from the microphone into electrical signals suitable for driving the acoustic output transducer according to the prescription. In a digital hearing aid, the reproducible frequency range may be conveniently split up into a plurality of frequency bands by a corresponding plurality of digital band-pass filters. This band-split allows the hearing aid to process each frequency band independently with respect to e.g. gain and compression, providing a highly flexible means of processing audio signals.

2. The Prior Art

WO-A1-98/27787 presents a hearing aid with a percentile estimator for determining noise levels and signal levels in an input signal for the hearing aid. A noise level is determined as a 10% percentile level of the input signal, and a signal level is determined as a 90% percentile level of the input signal. It is possible for the signal processor of the hearing aid to make an educated guess about the presence and the level of speech given the difference between the 90% percentile level and the 10% percentile level. In other words, the difference between the 90% percentile and the 10% percentile determines the level of speech. In the following, this method is denoted the percentile difference method. This way of detecting speech works to satisfaction in steady noise or in quiet surroundings, but may not perform adequately in sound environments where the noise varies a lot, e.g. in a cafeteria, at parties, or where background music is present, because the percentile difference method is rather sensitive to modulated noise.

WO-A1-2004/008801 discloses a hearing aid having means for calculating a speech intelligibility index (SII) of an input signal, and means for enhancing a speech signal by optimizing the SII value of the input signal. During use of the hearing aid, the SII value is constantly analyzed and the signal processing is continuously altered in order to keep the SII at an optimal value for the purpose of enhancing speech and reducing noise. The precision of this system is very high, but its adaptation speed is poor due to the complex and involved nature of the calculation of the speech intelligibility index. Whenever the noise level rises, the adaptation speed of the speech intelligibility noise reduction system is approximately 1.8-2 dB/s, and about 17 dB/s whenever the noise level falls, and this adaptation speed may not be sufficient, e.g. in sound environments where modulated noise is present.

SUMMARY OF THE INVENTION

According to the invention, in a first aspect, there is devised a hearing aid comprising means for enhancing speech, and a band-split filter, the speech-enhancing means comprising a speech detector and a selective gain controller, the band-split filter being configured for separating an input signal into a plurality of frequency bands, the speech detector having means for detecting a noise level, means for detecting a voiced speech signal and means for detecting an unvoiced speech signal in each frequency band of the plurality of frequency bands of the input signal, and the selective gain controller being adapted for increasing the gain level applied to the output signal by a predetermined amount in those frequency bands of the plurality of frequency bands where the voiced speech signal level is higher than the detected noise level.

By applying separate detection means for detecting voiced and unvoiced speech, respectively, in the speech detector, a faster and more confident speech detection results, in turn enabling a faster and more precise gain adjustment of the input signal in order to better enhance speech signals present in the input signal of the hearing aid. Since fewer non-speech signals are mistaken for speech by the speech detector, the subsequent speech-enhancing gain adjustments may be performed considerably faster without worrying about introducing artifacts into the process.

The invention, in a second aspect, provides a method of enhancing speech in a hearing aid, involving the steps of providing an input signal, splitting the input signal into a plurality of frequency bands, deriving an envelope signal from the input signal, determining at least one detected, voiced speech frequency from the envelope signal, determining a voiced speech probability from the number of detected, voiced speech frequencies, determining an unvoiced speech level from the input signal, identifying the frequency bands of the plurality of frequency bands where the speech level is higher than the noise level by a first, predetermined amount, and increasing the level of those frequency bands in the output signal of the hearing aid by a second, predetermined amount.

The separate detection of voiced and unvoiced speech components provided by the method of the invention makes it possible to detect the presence of speech in an input signal faster and with a higher degree of confidence than obtained by methods of the prior art, enabling speech enhancement to be performed by increasing the level in those frequency bands where speech dominates over noise, without the introduction of intelligibility-reducing artifacts.

Further features and embodiments are disclosed in the dependent claims.

Voiced-speech signals, i.e. vowel sounds, comprise a fundamental frequency and a finite number of corresponding harmonic frequencies. Unvoiced speech signals, i.e. fricatives, plosives or sibilants, on the other hand, comprise a broad spectrum of frequencies, and may be considered to be short bursts of sound. As the processing of speech signals is of major importance in a hearing aid, having means for detecting the presence or absence of speech in an arbitrary input signal would be very beneficial to the operation of a hearing aid processor. Formant frequencies play a very important role in the cognitive processes associated with recognizing and differentiating between different vowels in speech, and a hearing aid capable of utilizing information about voiced or unvoiced speech may thus optimize its signal processing accordingly in order to convey speech in a coherent and comprehensive manner, for instance when the hearing aid is detecting speech in modulated noise.

The hearing aid according to the invention comprises speech enhancement means for the purpose of exploiting the information conveyed by the speech detector. The speech enhancement means adjusts the gain of particular frequency bands whenever speech is detected. Dependent on the nature of the hearing loss to be compensated by the hearing aid, the speech enhancement means may increase the gain of frequency bands containing speech in order to favor those frequency bands at the cost of the frequency bands not containing speech.

In order to increase gain in the frequency bands where speech is present in a way which is coherent and free of artifacts, a number of conditions have to be fulfilled by the signal in each particular frequency band. Firstly, the speech detector must have detected speech, and the detected speech envelope level has to be above a predetermined minimum speech envelope level. If speech is detected, and the speech envelope level is sufficiently high, the particular frequency band is now examined in order to determine if the speech level dominates over the background noise level. This is performed by the hearing aid processor by utilizing the prior art speech detection strategy presented in WO98/27787 in a slightly modified form.

From the input signal present in each frequency band is derived a 90% percentile level, a slow 10% percentile level and a fast 10% percentile level. The slow 10% percentile level changes comparatively slowly. Thus, the 10% percentile level used in the gain calculation is calculated as the fast 10% percentile level minus the slow 10% percentile level, hereinafter denoted the 10% percentile level. Whenever speech is detected by the speech envelope detector, the difference between the 90% percentile level and the 10% percentile level equals the speech level, and the 10% percentile level equals the unmodulated noise level.

A frequency band having similar speech levels and noise levels at a given moment in time would exhibit annoying artifacts if additional gain were applied to the frequency band in order to enhance speech. Thus, a frequency-band-dependent level difference table is used to ensure that additional gain is exclusively applied by the speech enhancer to those frequency bands where the speech level is sufficiently dominant over the noise level. If the difference between the 90% percentile level and the 10% percentile level is larger than the difference stored in the frequency-band-dependent level difference table for that particular frequency band, additional gain may be applied to the frequency band for the purpose of enhancing speech.

BRIEF DESCRIPTION OF THE DRAWINGS

The invention will now be explained in greater detail with reference to the drawings, where.

DETAILED DESCRIPTION OF THE INVENTION

Figure 1:
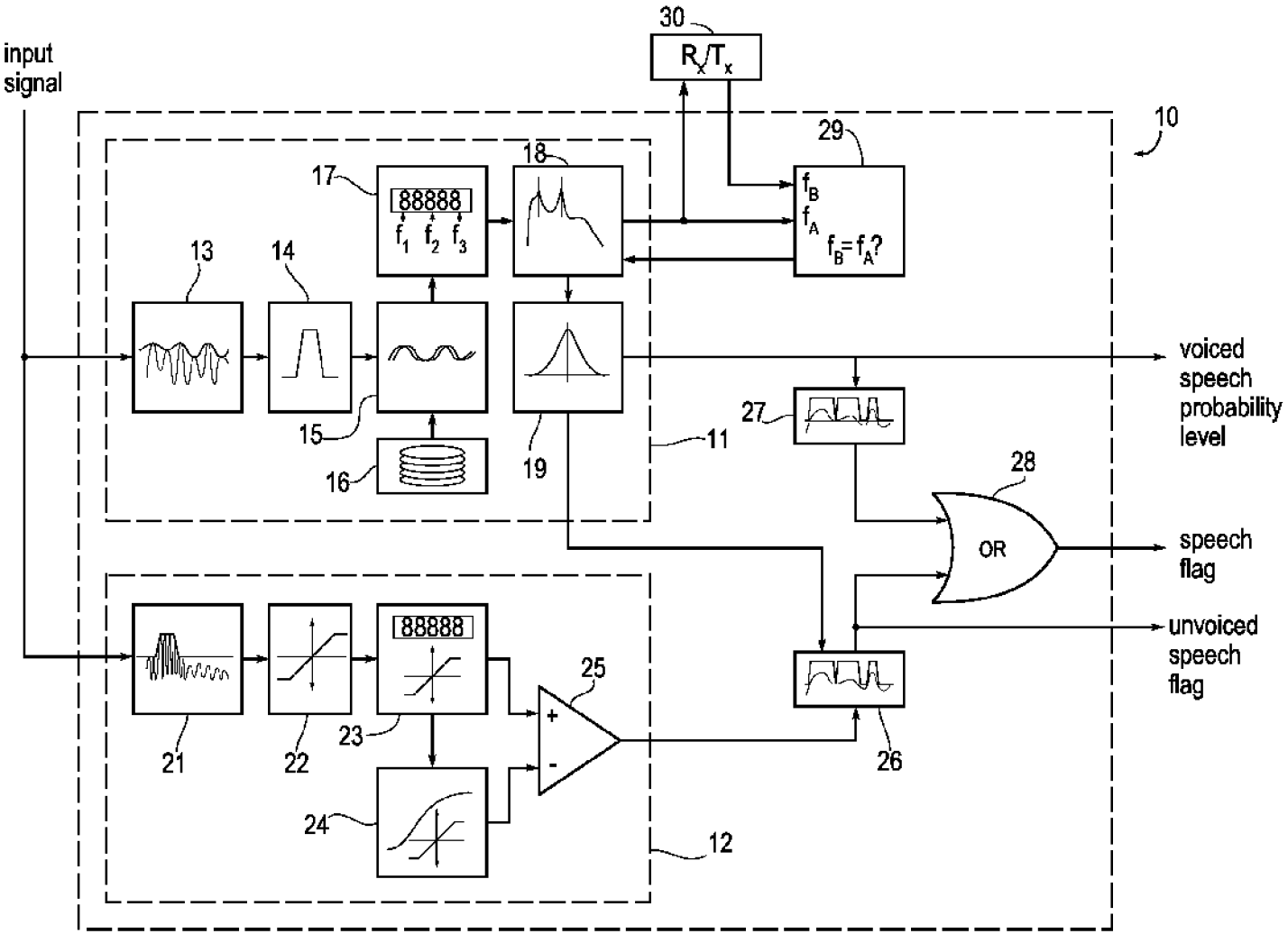
FIG. 1 is a block schematic of a speech detector forming part of an embodiment of the invention.

In FIG. 1 is shown a block schematic of a speech detector 10 for use in conjunction with the invention. The speech detector 10 is capable of detecting and discriminating voiced and unvoiced speech signals from an input signal, and it comprises a voiced-speech detector 11, an unvoiced-speech detector 12, an unvoiced-speech discriminator 26, a voiced-speech discriminator 27, an OR-gate 28, and a speech frequency comparator 29. The voiced-speech detector 11 comprises a speech envelope filter block 13, an envelope band-pass filter block 14, a frequency correlation calculation block 15, a characteristic frequency lookup table 16, a speech frequency count block 17, a voiced-speech frequency detection block 18, and a voiced-speech probability block 19. The unvoiced-speech detector 12 comprises a low level noise discriminator 21, a zero-crossing detector 22, a zero-crossing counter 23, a zero-crossing average counter 24, and a comparator 25. Also shown in FIG. 1 is a bidirectional transponder interface 30.

The speech detector 10 serves to determine the presence and characteristics of speech, voiced and unvoiced, in an input signal. This information can be utilized for performing speech enhancement in order to improve speech intelligibility to a hearing aid user. The signal fed to the speech detector 10 is a band-split signal from a plurality of frequency bands. The speech detector 10 operates on each frequency band in turn for the purpose of detecting voiced and unvoiced speech, respectively.

Voiced-speech signals have a characteristic envelope frequency ranging from approximately 75 Hz to about 285 Hz. A reliable way of detecting the presence of voiced-speech signals in a frequency band-split input signal is therefore to analyze the input signal in the individual frequency bands in order to determine the presence of the same envelope frequency, or the presence of the double of that envelope frequency, in all relevant frequency bands. This is done by isolating the envelope frequency signal from the input signal, band-pass filtering the envelope signal in order to isolate speech frequencies from other sounds, detecting the presence of characteristic envelope frequencies in the band-pass filtered signal, e.g. by performing a correlation analysis of the band-pass filtered envelope signal, accumulating the detected, characteristic envelope frequencies derived by the correlation analysis, and calculating a measure of probability of the presence of voiced speech in the analyzed signal from these factors thus derived from the input signal.

The correlation analysis performed by the frequency correlation calculation block 15 for the purpose of detecting the characteristic envelope frequencies is an autocorrelation analysis, and is approximated by:

$$R_{xx}(k) = \frac{1}{N}\sum_{n=0}^{N-1} x(n)\cdot x(n-k)$$

Where k is the characteristic frequency to be detected, n is the sample, and N is the number of samples used by the correlation window. The highest frequency detectable by the correlation analysis is defined by the sampling frequency $f_s$ of the system, and the lowest detectable frequency is dependent of the number of samples N in the correlation window, i.e.:

$$f_{max} = \frac{f_s}{k},\ f_{min} \approx f_s \cdot \frac{2}{N}$$

The correlation analysis is a delay analysis, where the correlation is largest whenever the delay time matches a characteristic frequency. The input signal is fed to the input of the voiced-speech detector 11, where a speech envelope of the input signal is extracted by the speech envelope filter block 13 and fed to the input of the envelope band-pass filter block 14, where frequencies above and below characteristic speech frequencies in the speech envelope signal are filtered out, i.e. frequencies below approximately 50 Hz and above 1 kHz are filtered out. The frequency correlation calculation block 15 then performs a correlation analysis of the output signal from the band-pass filter block 14 by comparing the detected envelope frequencies against a set of predetermined envelope frequencies stored in the characteristic frequency lookup table 16, producing a correlation measure as its output.

The characteristic frequency lookup table 16 comprises a set of paired, characteristic speech envelope frequencies (in Hz) similar to the set shown in table 1:

TABLE 1

Paired, characteristic speech envelope frequencies.

| | | | | | | | | | |
|---|---|---|---|---|---|---|---|---|---|
| 333 | 286 | 250 | 200 | 167 | 142 | 125 | 100 | 77 | 50 |
| — | 142 | 125 | 100 | 77 | 286 | 250 | 200 | 167 | — |

The upper row of table 1 represents the correlation speech envelope frequencies, and the lower row of table 1 represents the corresponding double or half correlation speech envelope frequencies. The reason for using a table of relatively few discrete frequencies in the correlation analysis is an intention to strike a balance between table size, detection speed, operational robustness and a sufficient precision. Since the purpose of performing the correlation analysis is to detect the presence of a dominating speaker signal, the exact frequency is not needed, and the result of the correlation analysis is thus a set of detected frequencies.

If a pure, voiced speech signal originating from a single speaker is presented as the input signal, only a few characteristic envelope frequencies will predominate in the input signal at a given moment in time. If the voiced speech signal is partially masked by noise, this will no longer be the case. Voiced speech may, however, still be determined with sufficient accuracy by the frequency correlation calculation block 15 if the same characteristic envelope frequency is found in three or more frequency bands.

The frequency correlation calculation block 15 generates an output signal fed to the input of the speech frequency count block 17. This input signal consists of one or more frequencies found by the correlation analysis. The speech frequency count block 17 counts the occurrences of characteristic speech envelope frequencies in the input signal. If no characteristic speech envelope frequencies are found, the input signal is deemed to be noise. If one characteristic speech envelope frequency, say, 100 Hz, or its harmonic counterpart, i.e. 200 Hz, is detected in three or more frequency bands, then the signal is deemed to be voiced speech originating from one speaker. However, if two or more different fundamental frequencies are detected, say, 100 Hz and 167 Hz, then voiced speech are probably originating from two or more speakers. This situation is also deemed as noise by the process.

The number of correlated, characteristic envelope frequencies found by the speech frequency count block 17 is used as an input to the voiced-speech frequency detection block 18, where the degree of predominance of a single voiced speech signal is determined by mutually comparing the counts of the different envelope frequency pairs. If at least one speech frequency is detected, and its level is considerably larger than the envelope level of the input signal, then voiced speech is detected by the system, and the voiced-speech frequency detection block 18 outputs a voiced-speech detection value as an input signal to the voiced-speech probability block 19. In the voiced-speech probability block 19, a voiced speech probability value is derived from the voiced-speech detection value determined by the voiced-speech frequency detection block 18. The voiced-speech probability value is used as the voiced-speech probability level output signal from the voiced-speech detector 11.

Unvoiced speech signals, like fricatives, sibilants and plosives, may be regarded as very short bursts of sound without any well-defined frequency, but having a lot of high-frequency content. A cost-effective and reliable way to detect the presence of unvoiced-speech signals in the digital domain is to employ a zero-crossing detector, which gives a short impulse every time the sign of the signal value changes, in combination with a counter for counting the number of impulses, and thus the number of zero crossing occurrences in the input signal within a predetermined time period, e.g. one tenth of a second, and comparing the number of times the signal crosses the zero line to an average count of zero crossings accumulated over a period of e.g. five seconds. If voiced speech has occurred recently, e.g. within the last three seconds, and the number of zero crossings is larger than the average zero-crossing count, then unvoiced speech is present in the input signal.

The input signal is also fed to the input of the unvoiced-speech detector 12 of the speech detector 10, to the input of the low-level noise discriminator 21. The low-level noise discriminator 21 rejects signals below a certain volume threshold in order for the unvoiced-speech detector 12 to be able to exclude background noise from being detected as unvoiced-speech signals. Whenever an input signal is deemed to be above the threshold of the low-level noise discriminator 21, it enters the input of the zero-crossing detector 22.

The zero-crossing detector 22 detects whenever the signal level of the input signal crosses zero, defined as ½ FSD (full-scale deflection), or half the maximum signal value that can be processed, and outputs a pulse signal to the zero-crossing counter 23 every time the input signal thus changes sign. The zero-crossing counter 23 operates in time frames of finite duration, accumulating the number of times the signal has crossed the zero threshold within each time frame. The number of zero crossings for each time frame is fed to the zero-crossing average counter 24 for calculating a slow average value of the number of zero crossings of several consecutive time frames, presenting this average value as its output signal. The comparator 25 takes as its two input signals the output signal from the zero-crossing counter 23 and the output signal from the zero-crossing average counter 24 and uses these two input signals to generate an output signal for the unvoiced-speech detector 12 equal to the output signal from the zero-crossing counter 23 if this signal is larger than the output signal from the zero-crossing average counter 24, and equal to the output signal from the zero-crossing average counter 24 if the output signal from the zero-crossing counter 23 is smaller than the output signal from the zero-crossing average counter 24.

The output signal from the voiced-speech detector 11 is branched to a direct output, carrying the voiced-speech probability level, and to an input of the voiced-speech discriminator 27. The voiced-speech discriminator 27 generates a HIGH logical signal whenever the voiced-speech probability level from the voiced-speech detector 11 rises above a first predetermined level, and a LOW logical signal whenever the speech probability level from the voiced-speech detector 11 falls below the first predetermined level.

The output signal from the unvoiced-speech detector 12 is branched to a direct output, carrying the unvoiced-speech level, and to a first input of the unvoiced-speech discriminator 26. A separate signal from the voiced-speech detector 11 is fed to a second input of the unvoiced-speech discriminator 26. This signal is enabled whenever voiced speech has been detected within a predetermined period, e.g. 0.5 seconds. The unvoiced-speech discriminator 26 generates a HIGH logical signal whenever the unvoiced speech level from the unvoiced-speech detector 12 rises above a second predetermined level and voiced speech has been detected within the predetermined period, and a LOW logical signal whenever the speech level from the unvoiced-speech detector 12 falls below the second predetermined level.

The OR-gate 28 takes as its two input signals the logical output signals from the unvoiced-speech discriminator 26 and the voiced-speech discriminator 27, respectively, and generates a logical speech flag for utilization by other parts of the hearing aid circuit. The speech flag generated by the OR-gate 28 is logical HIGH if either the voiced-speech probability level or the unvoiced-speech level is above their respective, predetermined levels and logical LOW if both the voiced-speech probability level and the unvoiced-speech level are below their respective, predetermined levels. Thus, the speech flag generated by the OR-gate 28 indicates if speech is present in the input signal.

The output signal from the voiced-speech frequency detection block 18 is also branched out into two signals fed to a first input of the speech frequency comparator 29 and an input of the bidirectional transponder interface 30, respectively. The signal of the first branch is fed to the bidirectional transponder interface 30, where it is prepared for wireless transmission to a contralateral hearing aid (not shown) by the bidirectional transponder interface 30. From the bidirectional transponder interface 30, a corresponding signal representing an output signal from the voiced-speech frequency detection block in the contralateral hearing aid (not shown) is presented as a first input signal, $f_B$, to the speech frequency comparator 29. The signal of the second branch from the voiced-speech frequency detection block 18 is fed as a second input signal, $f_A$, to the speech frequency comparator 29. The second input signal $f_A$ represents the speech frequencies found by the voiced-speech frequency detection block 18 in the ipse-lateral hearing aid, and the first input signal $f_B$ represents the speech frequencies found by the voiced-speech frequency detection block of the contralateral hearing aid (not shown).

In the speech frequency comparator 29, the two sets of speech frequencies $f_A$ and $f_B$ are compared. If similar speech frequencies are detected within a preset tolerance, the speech frequency comparator 29 generates a flag indicating that similar speech frequencies are detected by the speech detectors of both the ipse-lateral and the contralateral hearing aid. This information is fed back to the voiced-speech frequency detection block 18 and used for weighting the speech probability level derived by the voiced-speech probability block 19. If no speech frequencies are found by the contralateral hearing aid, or if the speech frequencies found by the contralateral hearing aid are considered to be different from the speech frequencies found by the ipse-lateral hearing aid, the speech frequencies found by the contralateral hearing aid are not taken into consideration when deriving the speech probability level.

If the speech frequencies found by the contralateral hearing aid are essentially the same as the speech frequencies found by the ipse-lateral hearing aid, this has a positive influence on the voiced speech probability level derived by the voiced-speech probability block 19. As this will also be the case in the contralateral hearing aid, considered to be structurally identical to the ipse-lateral hearing aid, the voiced speech probability level is also increased in the contralateral hearing aid. The net result of the increase in the speech probability level is that speech signals originating from a single speaker located in front of the hearing aid user makes both hearing aids detect the same speech frequencies, and thus in essence synchronize their speech detection.

Figure 2:
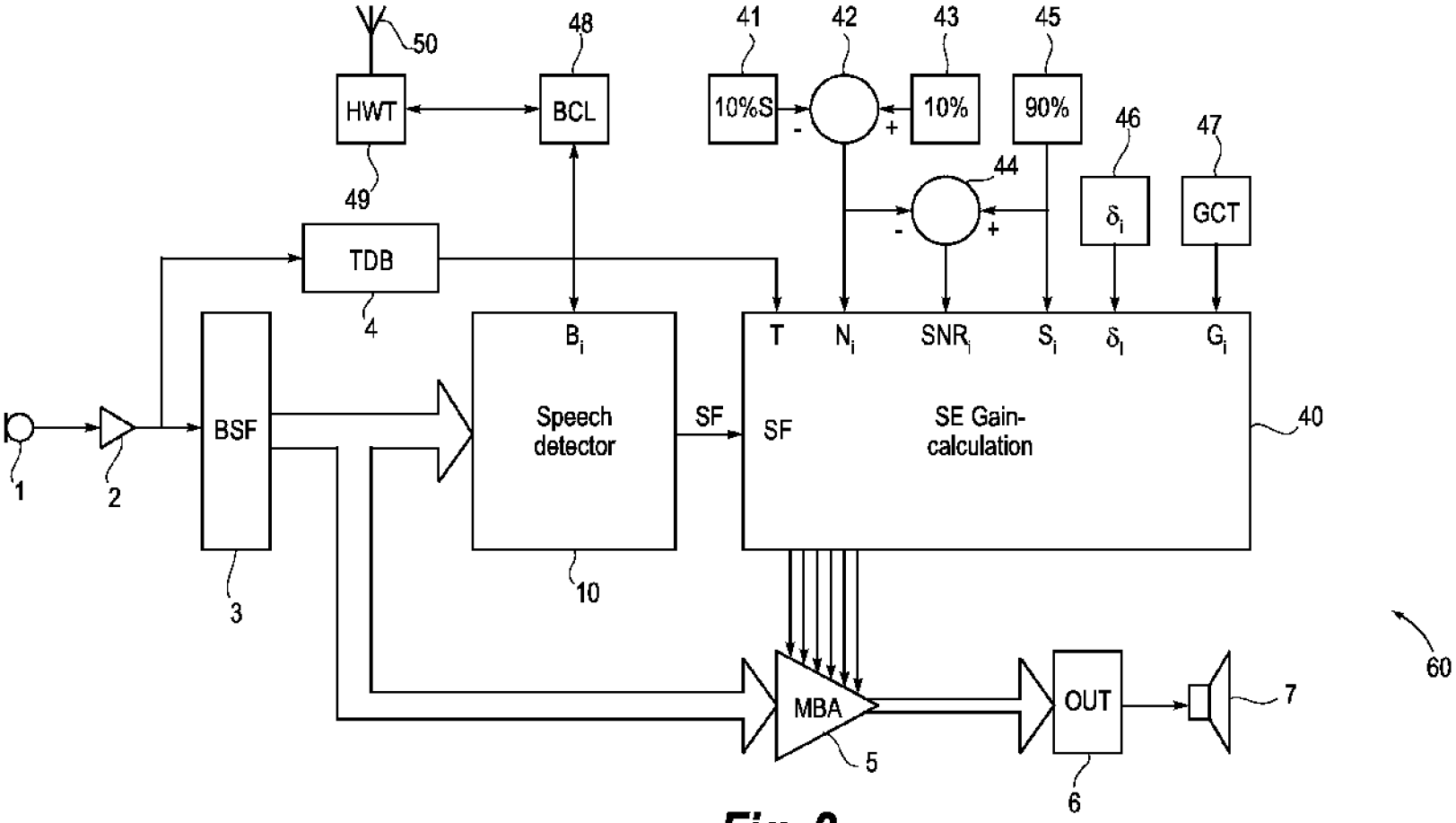
FIG. 2 is a block schematic of a hearing aid comprising a speech enhancer according to an embodiment of the invention.

The block schematic in FIG. 2 shows an embodiment of a hearing aid 60 having a speech enhancer according to the invention. The hearing aid 60 comprises an input source in the form of a microphone 1 connected to the input of an electronic input stage 2. The output of the electronic input stage 2 is split between the input of a band-split filter 3 and the input of a transient detection block 4, and the output of the band-split filter 3 is split into two outputs, one connected to a to a speech detector 10, and the other connected to a multi-band amplifier 5. The speech detector 10 is connected to a bidirectional communications link block 48, and the bidirectional communications link block 48 is connected to a hearing aid wireless transponder 49 having an antenna 50. Three output lines from the speech detector 10 is connected to the input of a speech enhancement gain calculation block 40 and a plurality of outputs of the speech enhancement gain calculation block 40 is connected to the input of the multi-band amplifier 5. The output of the multi-band amplifier 5 is connected to the input of an output stage 6, and the output of the output stage 6 is connected to the input of an acoustic output transducer 7.

The output of the transient detection block 4 is connected to an input of the speech enhancement gain calculation block 40 carrying a transient detection signal, or flag, T. A slow 10% percentile detection block 41, a first difference node 42, a fast 10% percentile detection block 43, a second difference node 44, a 90% percentile detection block 45, a minimal signal-to-noise difference table block 46, and a gain correction table block 47 are connected to separate inputs of the speech enhancement gain calculation block 40. The slow 10% percentile detection block 41, the fast 10% percentile detection block 43, and the 90% percentile detection block 45 all derive their output signals from the input signal by means not shown in FIG. 3.

The speech detector 10 performs the task of detecting the presence of voiced and unvoiced-speech signals in the input signal. In order to detect speech in a fast and reliable manner, detection of voiced and unvoiced speech signals, respectively, is performed independently by the speech detector 10. Based on the detection results, the speech detector 10 generates a speech flag signal SF for the speech enhancement gain calculation block 40 indicating the presence of speech, voiced or unvoiced, in the input signal.

Apart from using the speech detection flag SF from the speech detector 10, the speech enhancement gain calculation block 40 also uses the transient detection flag T from the transient detection block 4, the difference N, between the fast 10% percentile detection value from the fast 10% percentile detection block 43 and the slow 10% percentile detection value from the slow 10% percentile detection block 41 as presented by the first difference node 42, the 90% percentile value S, from the 90% percentile detection block 45, the difference between the 90% percentile detection value $S_i$ and the difference $N_i$ between the fast 10% percentile detection value and the slow 10% percentile detection value $SNR_i$ as presented by the second difference node 44, the minimal signal-to-noise difference value $\delta_i$ from the minimal signal-to-noise difference table block 46 and gain correction values $G_i$ from the gain correction table 47 to determine if a speech-enhancement gain factor should be applied to the gain value of the corresponding frequency band of the multi-band amplifier 5. The operation of the speech enhancement gain calculation block 40 is explained in further detail in the following.

The difference between the fast 10% percentile value and the slow 10% percentile value represents the background noise level $N_i$ n each of the individual frequency bands, the 90% percentile value represents the signal level $S_i$ in each of the individual frequency bands, and the difference between the 90% percentile value and the background noise level represents the signal-to-noise ratio $SNR_i$ in each of the individual frequency bands. The values from the minimal signal-to-noise difference table 46 represents the minimum signal-to-noise values $\delta_i$ in each individual frequency band i accepted by the speech enhancement gain calculator 40 for indicating the presence of a dominating speech signal in the input signal. The gain correction values from the gain correction table 47 represents the maximum gain enhancement values $G_i$ in the individual frequency bands.

Thus, the speech enhancement in the individual frequency bands of the hearing aid is calculated in the following manner: The signal-to-noise ratio in the frequency band i is:

$$SNR_i=S_i-N_i$$

A dominant speech signal is present in the frequency band i if:

$$SNR_i>\delta_i$$

The logical condition for enhancing speech in the frequency band i is:

$$SE_i=SF \text{ AND } \overline{T} \text{ AND } (SNR_i>\delta_i)$$

Where SF is the logical indicator that speech has been detected in the input signal, and T is a logical indicator that a transient is detected to be present in the input signal. When the conditions of this expression is true, the maximum speech enhancement gain value $G_i$ for the frequency band i is obtained from the speech enhancement gain value table 47, and a calculated gain value is added to the gain value of the frequency band i. The speech enhancement gain values added to each frequency band for enhancing detected speech are dependent of the frequency band i, the character of the hearing loss to be compensated, and the level of speech in the frequency band i, and are typically of the magnitude 2-4 dB. The maximum speech enhancement gain values $G_i$ are not to be exceeded, however.

In a preferred embodiment, the conditions SF and $SNR_i>\delta_i$ are combined with a timed delay (not shown). Any sufficiently modulated sound signal having high-frequency content may initially be detected as speech and trigger the speech enhancement gain calculation block 40. However, if the Speech flag SF is not set within a predetermined delay of, say, 10 milliseconds, then speech enhancement is "vetoed" out by the speech flag SF, and speech enhancement does not take place. In other words, if a broadband speech signal is not detected by the within that time, then the modulated sound signal is deemed to be not speech, but sound from another modulated source. These short engagements (typically 5-8 milliseconds) of the speech enhancement gain calculation block 40 are not audible, even to a normal hearing person.

The speed with which gain is added to the individual frequency bands in order to enhance speech signals present in those frequency bands are of the magnitude 400-500 dB/second. Field research has shown that a slower rate of gain increment has a tendency to introduce difficulties in speech comprehension, probably due to the fact that the beginning of certain spoken words may be missed by the gain increment, and a faster rate of gain increment, e.g. 600-800 dB/second, has a tendency to introduce uncomfortable artifacts into the signal, probably due to the transients artificially introduced by the fast gain increment.

In cases where two identical hearing aids are employed, it is beneficial to include means for mutually exchanging information regarding the presence and frequencies of detected speech in the input signal between the two hearing aids. For this purpose, the ipse-lateral hearing aid 60 in FIG. 2 has means for collecting relevant parameters intended for a contralateral hearing aid (not shown) and means for transmitting the parameters via the bidirectional communications link block 48 to the contralateral hearing aid. The bidirectional communications link block 48 comprises means for converting the parameters into data packets suitable for transmission via the hearing aid wireless transponder 49 and the antenna 50 to the contralateral hearing aid. The hearing aid wireless transponder 49 is also configured for receiving data packets representing similar parameters wirelessly from the contralateral hearing aid via the antenna 50.

The means for mutually exchanging information about speech signals detected in the input signals of two hearing aids allows several different, beneficial, speech-enhancing signal processing strategies to be employed. If e.g. a dominating speaker is positioned right in front of a user wearing two hearing aids, the speech detectors in the two hearing aids may detect the same speech frequencies but not necessarily detect the same speech level because different noise levels may be presented to the two hearing aids simultaneously. If the detected voiced-speech components comprise the same speech frequencies in both hearing aids, then both hearing aids are receiving speech from the same dominating speaker. If both hearing aids then agree mutually to perform speech enhancement on the same dominating speech signal, the speech enhancement gain levels introduced by the two hearing aids will be more alike, thus improving localization of the dominating speaker.

In another example, if the speaker is positioned to the right of the hearing aid user, then both the right hearing aid and the left hearing aid may indicate dominating speech signals, but the voiced speech components may have different frequencies and e.g. the ipse-lateral hearing aid relative to the person speaking may indicate a louder signal level than the contralateral hearing aid, and the contralateral hearing aid may receive noise, or speech from another person further away. This situation implies that the two hearing aids are not detecting the same dominating speaker. In this case, the contralateral hearing aid may temporarily disengage its speech enhancement altogether, thus favoring the speech enhancement provided by the ipse-lateral hearing aid, thanks to the mutual exchange of information regarding speech signals being accessible to either hearing aid processor. This may improve intelligibility of a speaker placed on one side of the hearing aid user, especially in sound environments where the type or level of noise would otherwise deteriorate speech comprehension.

Figure 3:
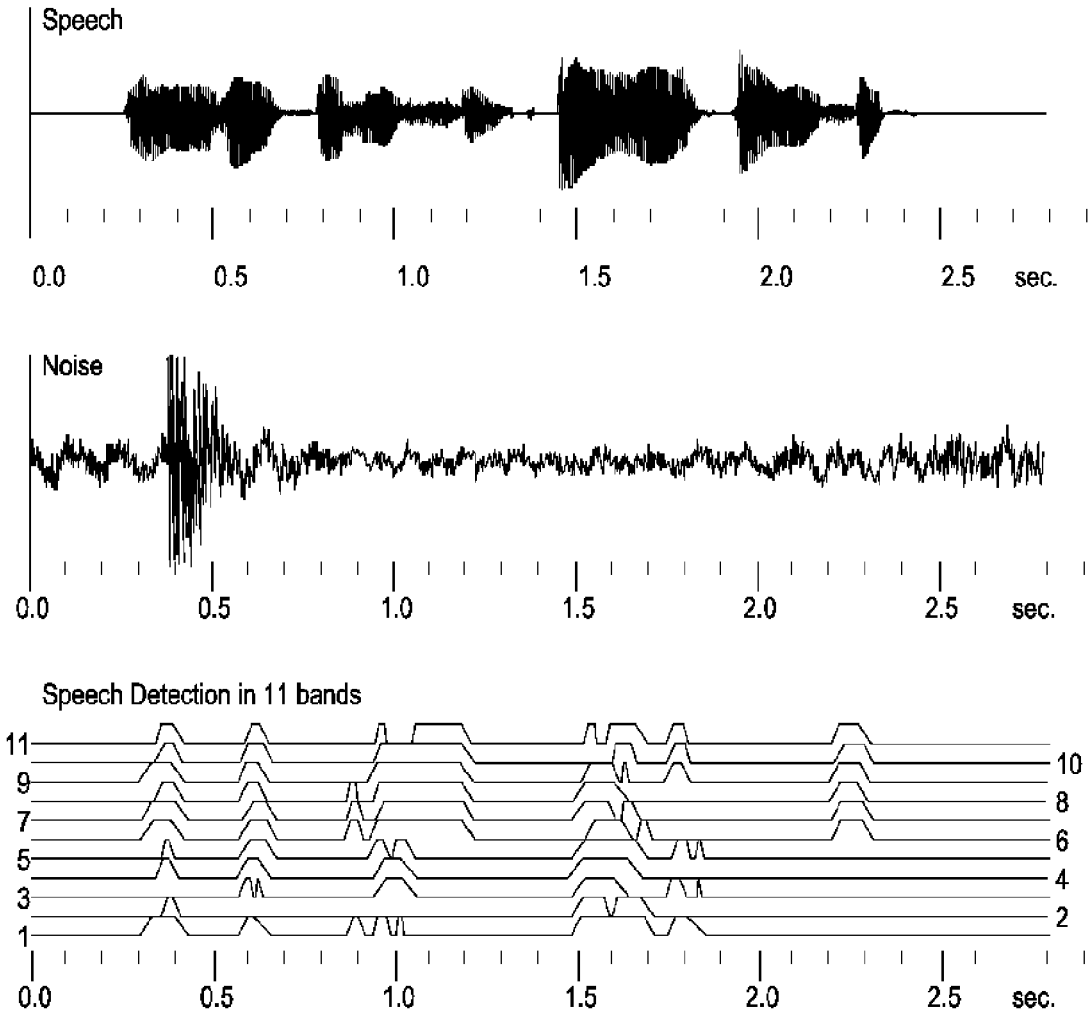
FIG. 3 is a graph illustrating how speech detection is performed according to an embodiment of the invention.

FIG. 3 is a set of three graphs illustrating the operating principle of the speech detector according to the invention. The upper graph shows the amplitude of a pure speech signal having a duration of approximately 2.5 seconds, the middle graph shows the amplitude of an unrelated noise signal (canteen noise) of roughly the same duration, and the third graph shows the output signal, also having the same duration, from a speech detector according to the invention operating on a plurality of frequency bands of an input signal generated by a superposition of the speech signal and the noise signal. The frequency bands shown in the third graph represent a range of frequency bands ranging from low to high, numbered 1-11 for convenience, with 1 representing the lowest frequency band and 11 the highest. The three graphs shown in FIG. 3 are considered to be aligned in time. The speech in the upper graph comprises four words of a spoken sentence, and the middle graph comprises a transient happening at approximately 0.38 seconds.

Figure 4:
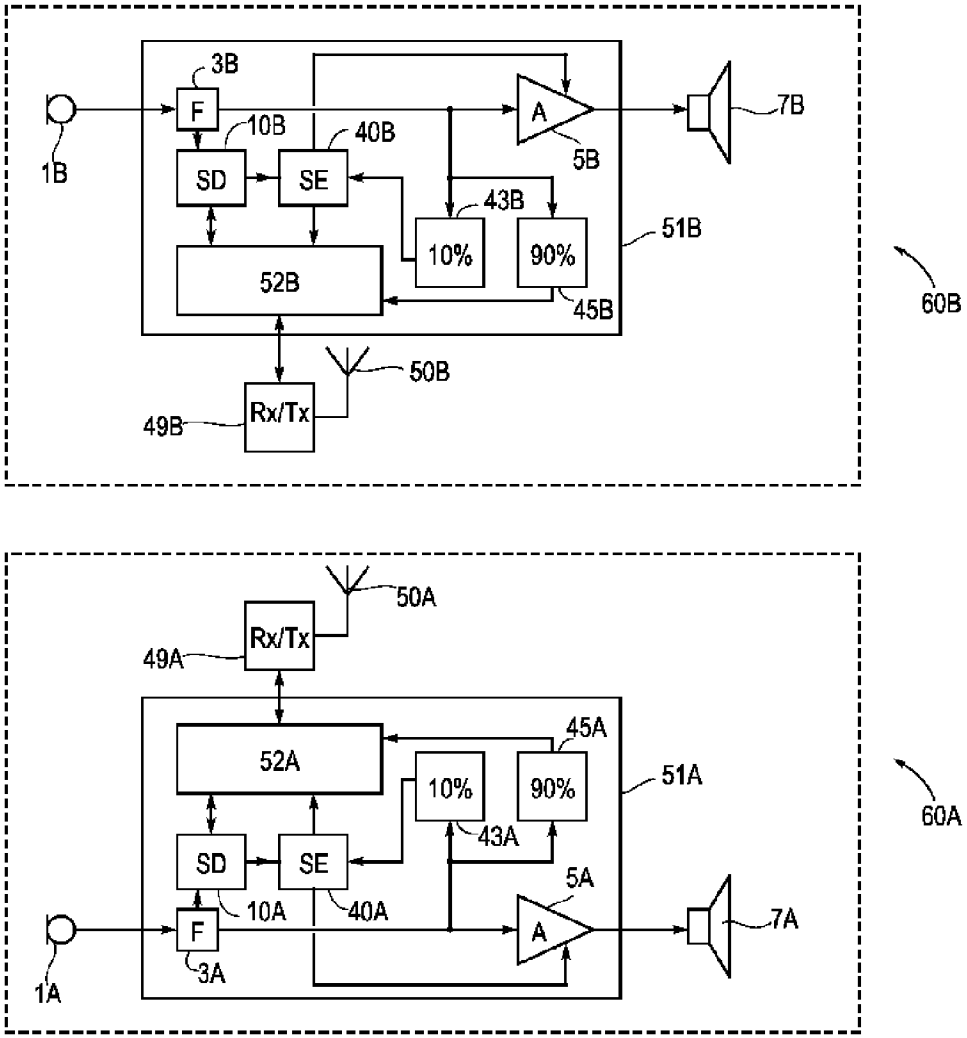
FIG. 4 is a block schematic of a system with two hearing aids having speech enhancers.

In the speech sample in FIG. 4, speech reaches a detectable level after approximately 0.3 seconds. However, a loud noise transient is present at approximately 0.38 seconds, temporarily masking out the speech. Since the transient is dominating over the speech, speech frequencies are not dominant in the input signal and speech enhancement is suspended. When the noise transient dies out, the speech detector detects the rest of the first word ending at approximately 0.68 seconds.

The second word of the spoken sentence has a duration of approximately 0.5 seconds, from 0.8 seconds to approximately 1.3 seconds of the sample. The second word of the spoken sentence is detected by the speech detector, and the speech enhancement gain calculator performs gain enhancement in the frequency bands where speech is detected. Sporadic speech signals are detected in the frequency bands 1, 3, 4 and 5, but speech signals of a somewhat longer duration (approximately 0.3 seconds) are detected in the frequency bands 6, 7, 8, 9, 10 and 11, and speech enhancement gain is applied to speech signals detected in those frequency bands. This is also an indication that more high-frequency content is present in the second word of the spoken sentence.

The third word of the spoken sentence has a duration of approximately 0.4 seconds, from 1.45 seconds to approximately 1.85 seconds of the sample. Here, speech is detected in all 11 frequency bands at various points throughout the duration of the word, but at different times. This allows the speech enhancement gain calculator to increase gain in the frequency bands where speech is present without affecting those parts of the signal not considered to be speech by the speech detector.

The fourth word of the spoken sentence has a duration of approximately 0.4 seconds, from 1.95 seconds to approximately 2.4 seconds of the sample. Here, another speaker (present in the canteen noise) is probably partly masking the beginning of the fourth word, and speech enhancement is therefore suspended until 2.2 seconds. The detection resumes for a rather short period when the masking speech ends, 0.15 seconds, where speech is detected in the frequency bands 6, 7, 8, 9, 10 and 11. These frequency bands are thus increased by the speech enhancement gain calculator during that period.

Several aspects of the operation of the speech detector may be concluded from the three graphs in FIG. 4. Firstly, the speech detector does not react to competing, voiced speech signals, e.g. from two speakers speaking at the same time, but reacts promptly to voiced speech signals from a single speaker. This feature ensures that speech enhancement is only applied to input signals where a presence of speech from one speaker is positively verified by the speech detector. Secondly, speech enhancement is temporarily suspended in all frequency bands if other sounds dominate in the input signal. Thirdly, the speech detection operates independently on the 11 frequency bands in the example. This increases the reliability of the speech detection and simplifies the operation of the speech enhancement gain calculator as it is possible to maintain a one-to-one relationship between each of the frequency bands in both the speech detector and the speech enhancement gain calculator.

In FIG. 4 is shown a block schematic of two hearing aids 60A, 60B, in mutual communication, each hearing aid having a speech enhancement system according to the invention. In FIG. 4, an ipse-lateral hearing aid 60A comprises a first microphone 1A, a first signal processor 51A, a first acoustic output transducer 7A, a first hearing aid wireless transponder 49A and a first antenna 50A. The first signal processor 51A of the ipse-lateral hearing aid 60A comprises a first filter bank 3A, a first speech detection block 10A, a first speech enhancement gain calculation block 40A, a first 10% percentile detection block 43A, a first 90% percentile detection block 45A, a first amplifier block 5A, and a first bidirectional communication interface 52A.

The first microphone 1A is connected to the first filter bank 3A, and the outputs from the first filter bank 3A are connected to the input of the first speech detector 10A and the first amplifier block 5A, respectively, and the output of the first amplifier block 5A is connected to the acoustic output transducer 7A. The signal from the first filter bank 3A to the first amplifier block 5A is also branched out to the inputs of the first 10% percentile detector 43A and the first 90% percentile detector 45A, respectively. The outputs of the first speech detector 10A are connected to the first speech enhancement gain calculation block 40A and the first bidirectional communications interface 52A, respectively, and the output of the first bidirectional communications interface 52A is connected to the first hearing aid wireless transponder 49A.

A contra-lateral hearing aid 60B comprises a second microphone 1B, a second signal processor 51B, a second acoustic output transducer 7B, a second hearing aid wireless transponder 49B and a second antenna 50B. The second signal processor 51B of the ipse-lateral hearing aid 60B comprises a second filter bank 3B, a second speech detection block 10B, a second speech enhancement gain calculation block 40B, a second 10% percentile detection block 43B, a second 90% percentile detection block 45B, a second amplifier block 5B, and a second bidirectional communication interface 52B.

The second microphone 1B is connected to the second filter bank 3B, and the outputs from the second filter bank 3B are connected to the input of the second speech detector 10B and the second amplifier block 5B, respectively, and the output of the second amplifier block 5B is connected to the second acoustic output transducer 7B. The signal from the second filter bank 3B to the second amplifier block 5B is also branched out to the inputs of the second 10% percentile detector 43B and the second 90% percentile detector 45B, respectively. The outputs of the second speech detector 10B are connected to the second speech enhancement gain calculation block 40B and the second bidirectional communications interface 52B, respectively, and the output of the second bidirectional communications interface 52B is connected to the second hearing aid wireless transponder 49B.

During use, the ipse-lateral hearing aid 60A exchanges information wirelessly with the contralateral hearing aid 60B. The information transmitted by the first wireless transponder 49A of the ipse-lateral hearing aid 60A comprises a set of voiced speech frequencies as detected by the voiced-speech detector (not shown) of the first speech detector 10A and the value of the 90% percentile as detected by the first 90% percentile detector 45A.

The second wireless transponder 49B of the contralateral hearing aid 60B is configured to receive information from the first transponder 49A of the ipse-lateral hearing aid 60A by the antenna 50B. The way the contralateral hearing aid 60B exploits the received information is explained in further detail in the following.

The 90% percentile value from the first 90% percentile detector 45A of the ipse-lateral hearing aid 60A is analyzed and compared with the corresponding percentile value from the second 90% percentile detector 45B in the contralateral hearing aid 60B. The voiced speech frequencies found by the first speech detector 10A of the ipse-lateral hearing aid 60A are compared with the voiced speech frequencies found by the second speech detector 10B of the contralateral hearing aid 60B.

If the voiced speech frequencies detected by the contralateral hearing aid 60B are substantially the same frequencies as detected by the ipse-lateral hearing aid 60A, then speech is considered to be originating from the same speaker, and speech enhancement is allowed in both hearing aids. If the voiced speech frequencies are considered to be different in the two hearing aids, this information is ignored, and the percentile values take precedence.

During use, the first wireless transponder 49A of the ipse-lateral hearing aid 60A listens continuously for speech detection data telegrams from the contralateral hearing aid 60B. In a binaural configuration, the speech detection data from the contralateral hearing aid 60B is used for modifying the speech enhancement in the ipse-lateral hearing aid 60A, either by mutually synchronizing the speech enhancement in both hearing aids as in the case where both hearing aids detect the same speech frequencies, or by disabling speech enhancement in the ipse-lateral hearing aid 60A, as in the case where both hearing aids detect different speech frequencies and percentile values indicate that the contralateral hearing aid detects the highest speech level. In cases where a contralateral hearing aid is absent, speech enhancement is still performed by the ipse-lateral hearing aid 60A, but data from the contralateral hearing aid 60B is no longer taken into consideration.

We claim:

1. A hearing aid comprising a speech-enhancing component, and a band-slit filter, the speech-enhancing component comprising a speech detector and a selective gain controller, the band-split filter being configured for separating an input signal into a plurality of frequency bands, the speech detector having a noise level detector a voiced speech signal detector for detecting a voiced speech signal and an unvoiced speech signal detector for detecting an unvoiced speech signal in each frequency band of the plurality of frequency bands of the input signal, and the selective gain controller being adapted for increasing the gain level applied to the output signal by a predetermined amount in those frequency bands of the plurality of frequency bands where the voiced speech signal level is higher than the detected noise level, wherein the selective gain controller is configured to compare a detected speech level to a detected noise level in each of the plurality of frequency bands and increase the gain level by a first, predetermined amount in each of those frequency bands of the plurality of frequency bands where the detected speech level exceeds the detected noise level by a second predetermined amount.

2. The hearing aid according to claim 1, wherein the voiced speech signal detector comprises an envelope filter for extracting an envelope signal from the input signal.

3. The hearing aid according to claim 2, wherein the voiced speech signal detector comprises a speech frequency counter for counting the number of detected, voiced speech frequencies present in the envelope signal and a voiced speech signal probability component for calculating a voiced speech probability level based on the detected number of speech frequencies.

4. The hearing aid according to claim 3, wherein the unvoiced speech detector comprises a zero-crossing rate counter and an averaging zero-crossing rate counter for detecting a level of unvoiced speech in the input signal.

5. The hearing aid according to claim 4, wherein the speech detector uses the voiced speech probability level and the unvoiced speech level to indicate a presence of speech in the input signal.

6. A hearing aid system comprising a first hearing aid and a second hearing aid according to claim 1, wherein the first and the second hearing aid comprises a communication component for mutually exchanging information regarding detected voiced speech frequencies and detected speech levels.

7. The hearing aid system according to claim 6, wherein the first hearing aid and the second hearing aid are configured to mutually exchange information regarding those frequency bands of the plurality of frequency bands in both hearing aids where the gain level has been increased.

8. A method of enhancing speech in a hearing aid, involving the steps of providing an input signal, splitting the input signal into a plurality of frequency bands, deriving an envelope signal from the input signal, determining at least one detected, voiced speech frequency from the envelope signal, determining a voiced speech probability from the number of detected, voiced speech frequencies, determining an unvoiced speech level from the input signal, identifying the frequency bands of the plurality of frequency bands where the speech level is higher than the noise level by a first, predetermined amount, and increasing the level of those frequency bands in the output signal of the hearing aid by a second, predetermined amount.

9. The method according to claim 8, wherein the step of determining a voiced speech probability involves the steps of performing a frequency correlation analysis on the envelope signal, determining the number of speech frequencies present in the envelope signal based on the frequency correlation analysis, and calculating a speech probability from the determined number of speech frequencies.

10. The method according to claim 8, wherein the step of determining an unvoiced speech level involves the steps of deriving a zero-crossing rate count of the input signal, deriving an averaged zero-crossing rate count from the input signal and the zero-crossing rate count, comparing the zero-crossing rate count with the averaged zero-crossing rate count, and calculating an unvoiced speech level by determining if the zero-crossing rate is higher than the averaged zero-crossing rate by a predetermined amount.

* * * * *